US008791892B2

(12) United States Patent
Kim et al.

(10) Patent No.: US 8,791,892 B2
(45) Date of Patent: Jul. 29, 2014

(54) LIQUID CRYSTAL DISPLAY CAPABLE OF RENDERING VIDEO DATA IN ACCORDANCE WITH A RENDERING STRUCTURE OF A DOUBLE RATE DRIVING PANEL

(75) Inventors: Minki Kim, Namyui-ri (KR); Jinsung Kim, Gumi-si (KR); Hayoung Ji, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 301 days.

(21) Appl. No.: 13/312,707

(22) Filed: Dec. 6, 2011

(65) Prior Publication Data

US 2012/0146963 A1 Jun. 14, 2012

(30) Foreign Application Priority Data

Dec. 10, 2010 (KR) ..... 10-2010-0126547

(51) Int. Cl.
*G09G 3/36* (2006.01)

(52) U.S. Cl.
CPC ..... *G09G 3/3648* (2013.01); *G09G 3/3688* (2013.01); *G09G 2300/0439* (2013.01); *G09G 2300/0426* (2013.01); *G09G 2310/0297* (2013.01)
USPC ..... 345/94; 345/99

(58) Field of Classification Search
CPC ..... G09G 5/00; G09G 3/36; G11C 19/287; G11C 19/38; G11C 27/04
USPC ..... 345/55, 98–100; 326/62, 63, 80; 327/333
See application file for complete search history.

(56) References Cited

U.S. PATENT DOCUMENTS

| | | | | |
|---|---|---|---|---|
| 5,786,800 | A * | 7/1998 | Gyouten | 345/98 |
| 2003/0189537 | A1 * | 10/2003 | Yun | 345/87 |
| 2006/0077164 | A1 * | 4/2006 | Ahn | 345/94 |
| 2010/0127960 | A1 * | 5/2010 | Jung et al. | 345/89 |

FOREIGN PATENT DOCUMENTS

| | | | |
|---|---|---|---|
| CN | 101751887 | A | 6/2010 |
| TW | I227452 | B | 2/2005 |

OTHER PUBLICATIONS

Office Action issued in corresponding Taiwan Patent Application No. 100145106, mailed Nov. 26, 2013, 9 pages.

* cited by examiner

*Primary Examiner* — Chanh Nguyen
*Assistant Examiner* — Ram Mistry
(74) *Attorney, Agent, or Firm* — Brinks Gilson Lione

(57) ABSTRACT

A liquid crystal display includes a liquid crystal display panel having a pixel array including a first group of liquid crystal cells connected to odd-numbered gate lines and a second group of liquid crystal cells connected to even-numbered gate lines and a data driving circuit including a latch array. Each liquid crystal cell of the second group shares a data line with one liquid crystal cell of the first group adjacent to the liquid crystal cell of the second group in an extension direction of the gate lines. The latch array delays only second group data to be applied to the liquid crystal cells of the second group among digital video data for one horizontal line by about one half horizontal period in response to a data rendering control signal.

9 Claims, 11 Drawing Sheets

(A) Normal Panel (B) DRD Panel

Data writing sequence (A) Normal Panel Rendering (B) DRD Panel Rendering

REO : Odd-numbered rising edge
REE : Even-numbered rising edge
FEO : Odd-numbered falling edge
FEE : Even-numbered falling edge

LIQUID CRYSTAL DISPLAY CAPABLE OF RENDERING VIDEO DATA IN ACCORDANCE WITH A RENDERING STRUCTURE OF A DOUBLE RATE DRIVING PANEL

This application claims the priority and the benefit under 35 U.S.C. §119(a) on Patent Application No. 10-2010-0126547 filed in Republic of Korea on Dec. 10, 2010 the entire contents of which are hereby incorporated by reference.

BACKGROUND

1. Field of the Invention

Embodiments of the invention relates to a liquid crystal display capable of reducing the number of output channels of a data driving circuit.

2. Discussion of the Related Art

An active matrix type liquid crystal display displays a moving picture using a thin film transistor (TFT) as a switching element. The active matrix type liquid crystal display has been implemented in televisions as well as display devices in portable devices such as office equipments and computers, because of the thin profile of the active matrix type liquid crystal displays. Accordingly, a cathode ray tube (CRT) is being rapidly replaced by the active matrix type liquid crystal display. Liquid crystal cells of the liquid crystal display displays an image by changing a transmittance depending on a voltage difference between a data voltage supplied to a pixel electrode and a common voltage supplied to a common electrode.

Measures for changing the connection configuration of liquid crystal cells of a liquid crystal display panel of the liquid crystal display are being continuously implemented, so as to reduce the number of output channels of a data driving circuit. FIG. 1 illustrates the comparison between a general normal panel and a double rate driving (DRD) panel for reducing the number of output channels.

The normal panel shown in (A) of FIG. 1 may realize a horizontal resolution of 800 using 2400 (=800×3(RGB)) data lines DL. Because output channels of the data driving circuit are respectively connected to the data lines DL, the data driving circuit for driving the normal panel requires 2400 output channels.

The DRD panel shown in (B) of FIG. 1 may realize a horizontal resolution of 800 using only 1200 data lines DL because a pair of adjacent left and right liquid crystal cells commonly use one data line DL positioned between the pair of left and right liquid crystal cells. Thus, the number of output channels of the data driving circuit for driving the DRD panel is reduced to one half (i.e., 1,200) of the number of output channels of the normal panel shown in (A) of FIG. 1.

However, the DRD panel has a panel rendering structure in which the liquid crystal cells sharing the data line DL receive data in a time-division manner. Thus, a timing controller has to change an alignment sequence of video data in accordance with the panel rendering structure. This is described in detail with reference to FIG. 2.

In general, an input sequence of video data input to the timing controller from a system board is in agreement with the normal panel rendering structure shown in (A) of FIG. 1. In this instance, the timing controller synchronizes the output sequence of the video data with the input sequence thereof from the system board as shown in (A) of FIG. 2. Namely, the timing controller outputs video data for one horizontal line to the data driving circuit in the order of R0, G0, B0, R1, G1, B1 . . . R799, G799, and B799.

On the other hand, in the DRD panel rendering structure shown in (B) of FIG. 1, video data is written in the direction indicated by the arrow shown in (B) of FIG. 1. Thus, the timing controller has to align video data input from the system board in the order of R0, G0, B0, R1, G1, B1 . . . R799, G799, and B799 in accordance with the data writing sequence indicated by the arrow direction. The timing controller time-divides one horizontal period for applying video data for 1 horizontal line, and respectively aligns pre-charge data for 1/2 horizontal line to be written first in the order ① and post-charge data for 1/2 horizontal line to be written later in the order ②. The timing controller aligns the pre-charge data in the order of R0, R1, B1, R2, R3, B3 . . . R796, R797, B797, R798, R799, and B799, and then outputs the pre-charge data to the data driving circuit in this alignment sequence during the first half of the horizontal period. The pre-charge data includes all the red (R) data R0, R1, R2, R3 . . . R796, R797, R798, and R799, and one half odd-numbered blue (B) data B1, B3, B797, and B799, both of which are to be written within the one horizontal period. The timing controller aligns the post-charge data in the order of G0, B0, G1, G2, B2, G3 . . . G796, B796, G797, G798, B798, and G799, and then outputs the post-charge data to the data driving circuit in this alignment sequence during the second half of the horizontal period. The post-charge data includes all the green (G) data G0, G1, G2, G3 . . . G796, G797, G798, and G799 and the other half even-numbered blue (B) data B0, B2 . . . B796, and B798, both of which are to be written within the horizontal period.

As such, the liquid crystal display having the DRD panel necessarily requires a line memory for storing input video data for each horizontal line as shown in FIG. 3 because the alignment sequence of video data has to be changed in accordance with the panel rendering structure. This causes an increase in the manufacturing cost.

BRIEF SUMMARY

In one aspect, there is a liquid crystal display including a liquid crystal display panel having a pixel array including a first group of liquid crystal cells connected to odd-numbered gate lines and a second group of liquid crystal cells connected to even-numbered gate lines, wherein each liquid crystal cell of the second group is configured to share a data line with one liquid crystal cell of the first group adjacent to the liquid crystal cell of the second group in an extension direction of the gate lines, a data driving circuit configured to drive data lines of the pixel array in a time-division manner, the data driving circuit including a latch array, and a timing controller configured to supply digital video data to the data driving circuit and control operation timing of the data driving circuit, wherein the latch array delays only second group data to be applied to the liquid crystal cells of the second group among the digital video data for one horizontal line by one half horizontal period in response to a data rendering control signal and temporally separates first group data to be applied to the liquid crystal cells of the first group from the second group data to be applied to the liquid crystal cells of the second group.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE DRAWINGS AND THE PRESENTLY PREFERRED EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Exemplary embodiments of the invention will be described with reference to FIGS. 4 to 11.

Figure 4:
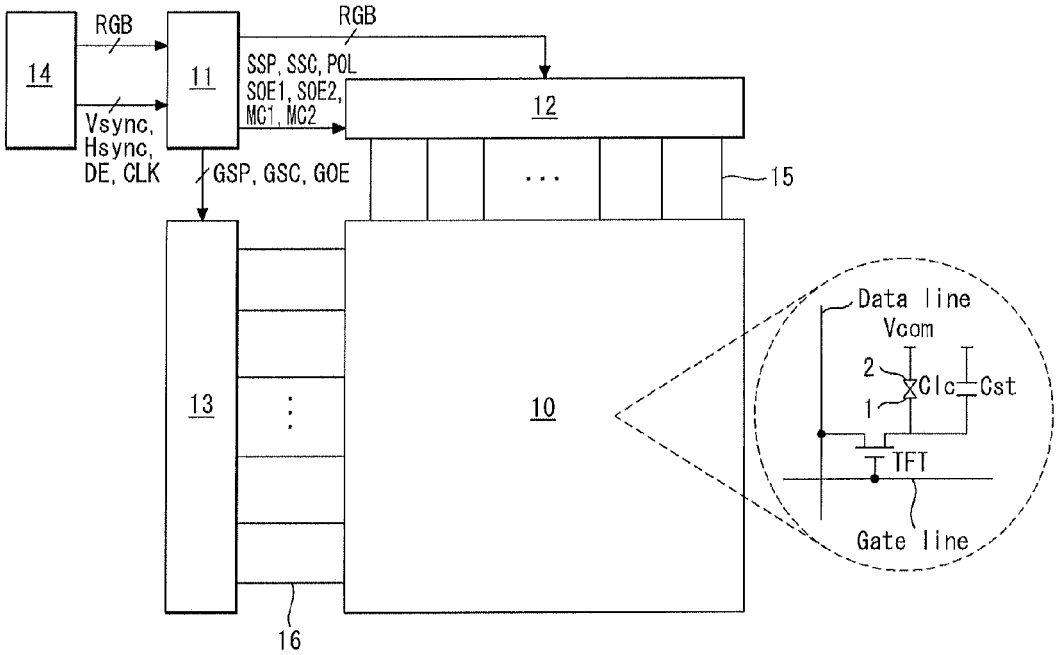
FIG. 4 illustrates a liquid crystal display according to an exemplary embodiment of the invention.

FIG. 4 illustrates a liquid crystal display according to an exemplary embodiment of the invention.

As shown in FIG. 4, the liquid crystal display according to the exemplary embodiment of the invention includes a liquid crystal display panel 10, a timing controller 11, a data driving circuit 12, and a gate driving circuit 13.

The liquid crystal display panel 10 includes an upper glass substrate, a lower glass substrate, and a liquid crystal layer between the upper and lower glass substrates. The liquid crystal display panel 10 includes liquid crystal cells Clc disposed in a matrix form of data lines 15 and gate lines 16 crossing each other.

Figure 5:
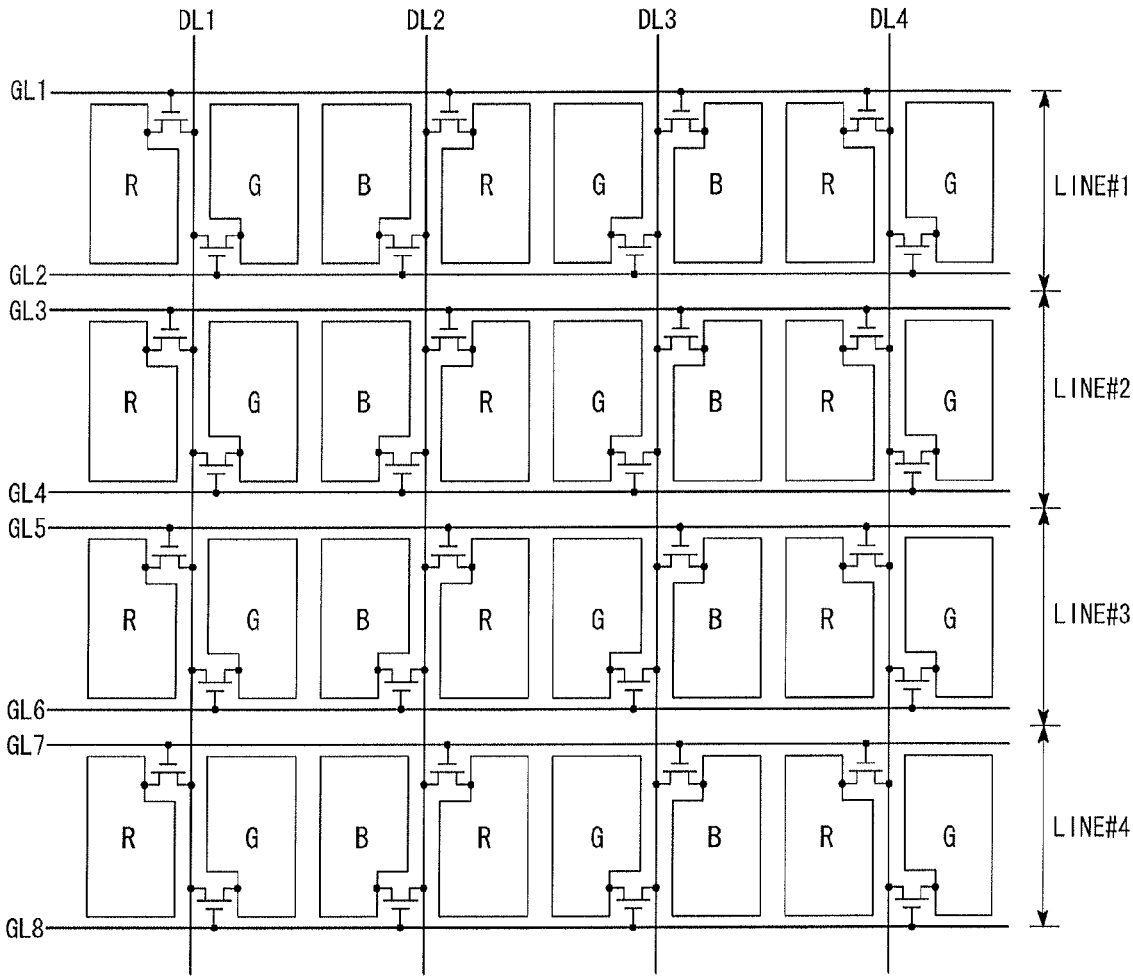
FIG. 5 illustrates a pixel array of a liquid crystal display panel having a DRD structure.

A pixel array is formed on the lower glass substrate of the liquid crystal display panel 10. The pixel array includes the liquid crystal cells Clc formed at crossings of the data lines 15 and the gate lines 16, thin film transistors (TFTs) connected to pixel electrodes 1 of the liquid crystal cells, and storage capacitors Cst. The pixel array may be implemented as shown in FIG. 5. The liquid crystal cells Clc are connected to the TFTs and driven by an electric field between the pixel electrode 1 and a common electrode 2. Black matrixes, color filters, etc. are formed on the upper glass substrate of the liquid crystal display panel 10. Polarizing plates are respectively attached to the upper and lower glass substrates of the liquid crystal display panel 10. Alignment layers for setting a pre-tilt angle of liquid crystals are respectively formed on the upper and lower glass substrates of the liquid crystal display panel 10.

The common electrodes 2 are formed on the upper glass substrate in a vertical electric field driving manner such as a twisted nematic (TN) mode and a vertical alignment (VA) mode. On the other hand, the common electrodes 2 are formed on the lower glass substrate along with the pixel electrodes 1 in a horizontal electric field driving manner such as an in-plane switching (IPS) mode and a fringe field switching (FFS) mode.

The liquid crystal display panel 10 applicable to the embodiment of the invention may be implemented in any liquid crystal mode as well as the TN, VA, IPS, and FFS modes. Moreover, the liquid crystal display according to the embodiment of the invention may be implemented as any type liquid crystal display including a backlit liquid crystal display, a transflective liquid crystal display, and a reflective liquid crystal display. A backlight unit is necessary in the backlit liquid crystal display and the transflective liquid crystal display. The backlight unit may be a direct type backlight unit or an edge type backlight unit.

Figure 2:
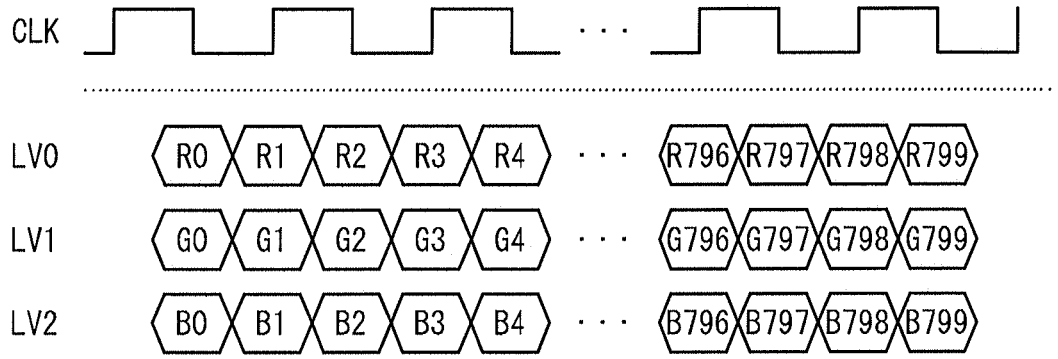
FIG. 2 (RELATED ART)
FIG. 2 illustrates the alignment sequences of video data in the normal panel and the DRD panel.
Figure 2:
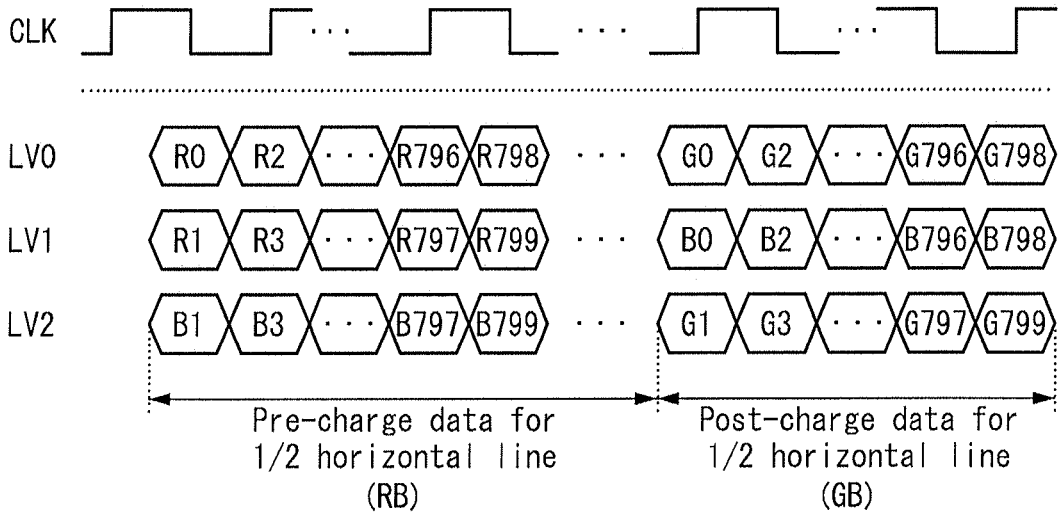
FIG. 2 (RELATED ART)
Figure 3:
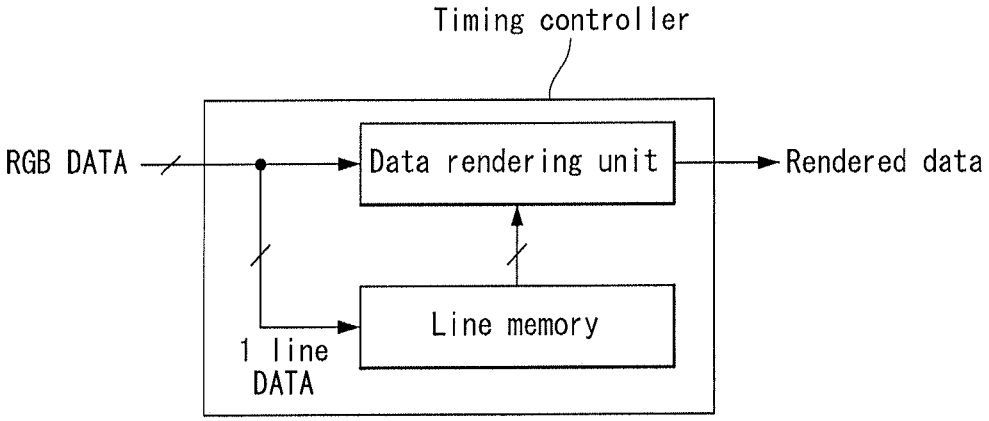
FIG. 3 (RELATED ART)
FIG. 3 illustrates a timing controller of a related art liquid crystal display having a DRD panel.

The timing controller 11 receives digital video data RGB of an input image from a system board 14 in a low voltage differential signaling (LVDS) interface manner and supplies the digital video data RGB of the input image to the data driving circuit 12 in a mini-LVDS interface manner. The timing controller 11 supplies the digital video data RGB received from the system board 14 to the data driving circuit 12 in the same order as they are received without being aligned in accordance with a rendering structure of the pixel array shown in FIG. 5. Namely, as shown in (A) of FIG. 2, the timing controller 11 outputs the digital video data RGB for one horizontal line to the data driving circuit 12 in the order of R0, G0, B0, R1, G1, B1 . . . R799, G799, and B799.

The timing controller 11 receives timing signals, such as a vertical synchronization signal Vsync, a horizontal synchronization signal Hsync, a data enable signal DE, and a dot clock CLK, from the system board 14 and generates control signals for controlling operation timing of the data driving circuit 12 and the gate driving circuit 13. The control signals include a gate timing control signal for controlling the operation timing of the gate driving circuit 13 and a data timing control signal for controlling the operation timing of the data driving circuit 12 and a vertical polarity of a data voltage. The timing controller 11 may multiply the frequency of the gate timing control signal by the frequency of the data timing control signal based on a frame frequency of (60xi) Hz, where T is a positive integer, so that the digital video data RGB input at a frame frequency of 60 Hz can be displayed on the pixel array of the liquid crystal display panel 10 at the frame frequency of (60xi) Hz.

The gate timing control signal includes a gate start pulse GSP, a gate shift clock GSC, a gate output enable signal GOE, etc. The gate start pulse GSP is applied to a gate drive integrated circuit (IC) to generate a first gate pulse and controls the gate drive IC so that it generates the first gate pulse. The gate shift clock GSC is commonly input to the gate drive ICs of the gate driving circuit 13 and shifts the gate start pulse GSP. The gate output enable signal GOE controls an output of the gate drive ICs.

Figure 7:
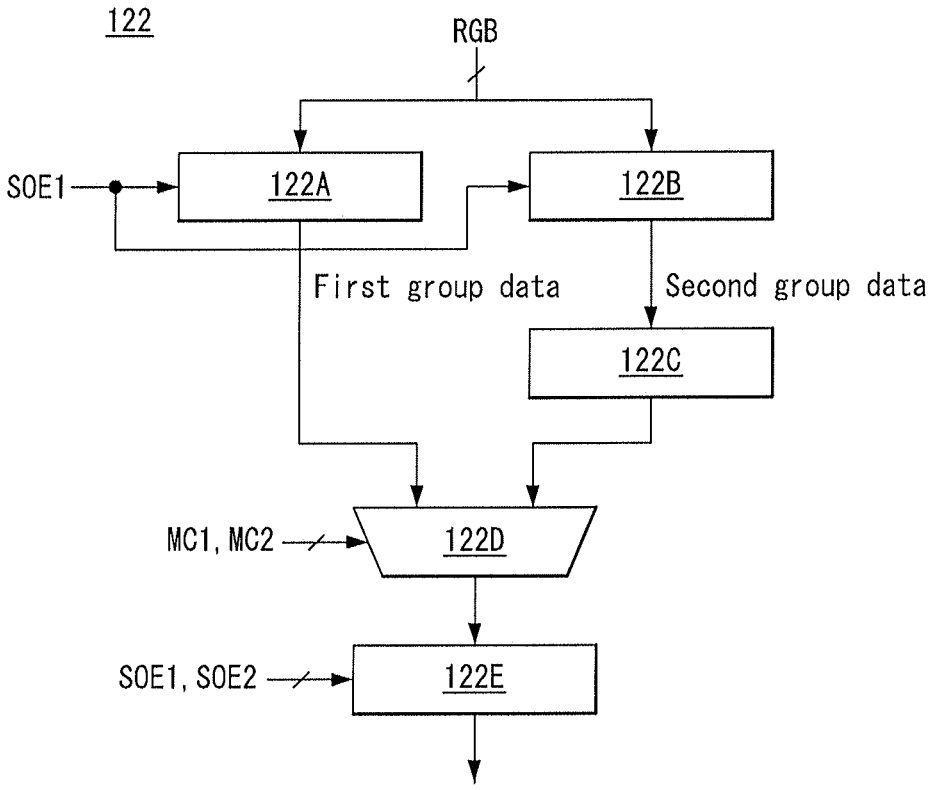
FIG. 7 illustrates a detailed configuration of a latch array capable of rendering data.

The data timing control signal includes a source start pulse SSP, a source sampling clock SSC, a vertical polarity control signal POL, a horizontal polarity control signal HINV, a source output enable signal SOE, etc. The source start pulse SSP controls a data sampling start timing of the data driving circuit 12. The source sampling clock SSC controls a sampling timing of data in the data driving circuit 12 based on its rising or falling edge. The vertical polarity control signal POL controls vertical polarities of data voltages sequentially output from each of a plurality of source drive ICs of the data driving circuit 12. The source output enable signal SOE controls an output timing of the data driving circuit 12. The source output enable signal SOE includes a first source output enable signal SOE1 and a second source output enable signal SOE2. The first source output enable signal SOE1 controls an output timing of data to be applied to the liquid crystal cells connected to the odd-numbered gate lines GL1, GL3, GL5, and GL7 in the pixel array of FIG. 5. The second source output enable signal SOE2 controls an output timing of data to be applied to the liquid crystal cells connected to the even-numbered gate lines GL2, GL4, GL6, and GL8 in the pixel array of FIG. 5. As shown in FIG. 7, MUX control signals MC1 and MC2 control an output operation of a multiplexer 122D included in the data driving circuit 12. The source output enable signals SOE1 and SOE2 and the MUX control signals MC1 and MC2 function as data rendering control signals.

The data driving circuit 12 may include the plurality of source drive ICs. Each of the source drive ICs includes a shift register, a latch array, a digital-to-analog converter, an output circuit, etc. The data driving circuit 12 latches the digital video data RGB in response to the data timing control signal and converts the latched digital video data RGB into positive and negative analog gamma compensation voltages. The data driving circuit 12 then outputs the data voltages, whose polarities are inverted every predetermined cycle, to the data lines 15.

In particular, the data driving circuit 12 performs data rendering in accordance with the rendering structure of the pixel array shown in FIG. 5 by changing the latch array. Hence, a line memory may be omitted from the timing controller 11.

The gate driving circuit 13 may include the plurality of gate drive ICs. The gate driving circuit 13 sequentially supplies a gate pulse to the gate lines 16 in response to the gate timing control signal using a shift register and a level shifter. The shift register of the gate driving circuit 13 may be directly formed on the lower glass substrate through a gate-in-panel (GIP) process.

FIG. 5 illustrates the pixel array of the liquid crystal display panel 10 having a DRD structure.

In the pixel array shown in FIG. 5, red liquid crystal cells to which red data (R) is applied, green liquid crystal cells to which green data (G) is applied, and blue liquid crystal cells to which blue data (B) is applied are arranged along a column direction. In the pixel array, one pixel includes a red liquid crystal cell, a green liquid crystal cell, and a blue liquid crystal cell that are adjacent in a row direction crossing the column direction. The liquid crystal cells adjacent in the row direction in the pixel array share the same data line and are continually charged with the data voltage supplied through the data line in a time-division manner.

To this end, a pair of liquid crystal cells sharing the same data line are connected to the adjacent gate lines, respectively. All the red liquid crystal cells among the liquid crystal cells disposed on horizontal lines LINE#1 to LINE#4 are connected to the odd-numbered gate lines GL1, GL3, GL5, and GL7. All the green liquid crystal cells among the liquid crystal cells disposed on the horizontal lines LINE#1 to LINE#4 are connected to the even-numbered gate lines GL2, GL4, GL6, and GL8. One half of the blue liquid crystal cells among the liquid crystal cells disposed on the horizontal lines LINE#1 to LINE#4 are connected to the odd-numbered gate lines GL1, GL3, GL5, and GL7, and the other half thereof are connected to the even-numbered gate lines GL2, GL4, GL6, and GL8. Hereinafter, for the convenience of explanation, the liquid crystal cells connected to the odd-numbered gate lines GL1, GL3, GL5, and GL7 are referred to as a first group of liquid crystal cells, and the liquid crystal cells connected to the odd-numbered gate lines GL2, GL4, GL6, and GL8 are referred to as a second group of liquid crystal cells. Each liquid crystal cell of the second group shares the data line with one liquid crystal cell of the first group adjacent to the liquid crystal cell of the second group in an extension direction of the gate lines.

Figure 1:
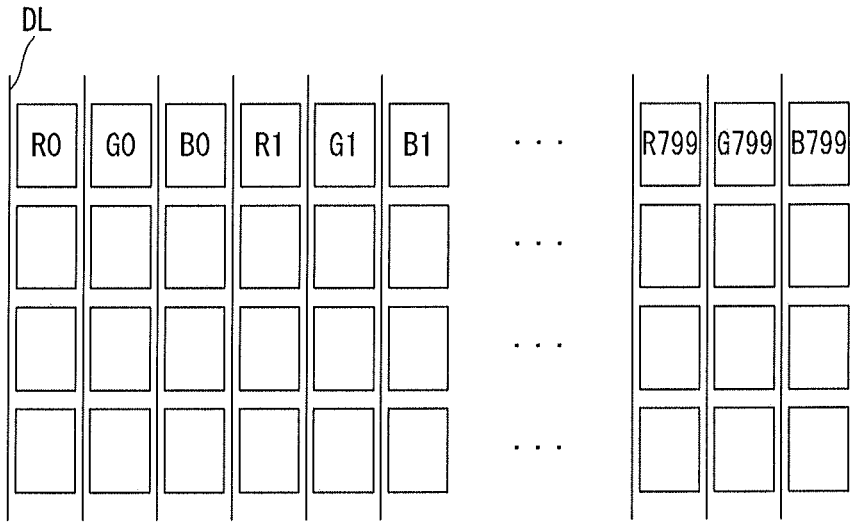
FIG. 1 (RELATED ART)
FIG. 1 illustrates the comparison between a general normal panel and a double rate driving (DRD) panel for reducing the number of output channels.
Figure 1:
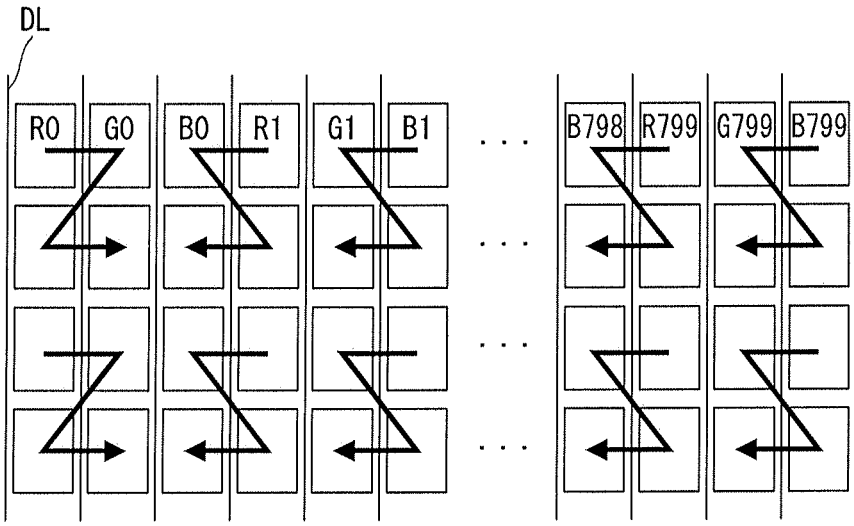
FIG. 1 (RELATED ART)
Figure 1:
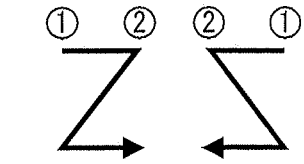
FIG. 1 (RELATED ART)

When the odd-numbered gate lines connected to the liquid crystal cells of the first group are activated, the liquid crystal cells of the first group on a kth (where k is a positive integer) horizontal line are charged with pre-charge data for 1/2 horizontal line written in the order of ① shown in (B) of FIG. 1 during a first half period (i.e., 1/2 horizontal period) of one horizontal period. When the even-numbered gate lines connected to the liquid crystal cells of the second group are activated, the liquid crystal cells of the second group on the kth horizontal line are charged with post-charge data for 1/2 horizontal line written in the order of ② shown in (B) of FIG. 1 during a second half period (i.e., 1/2 horizontal period) of the one horizontal period. Hereinafter, for the convenience of explanation, the pre-charge data is referred to as first group data, and the post-charge data is referred to as second group data.

Figure 6:
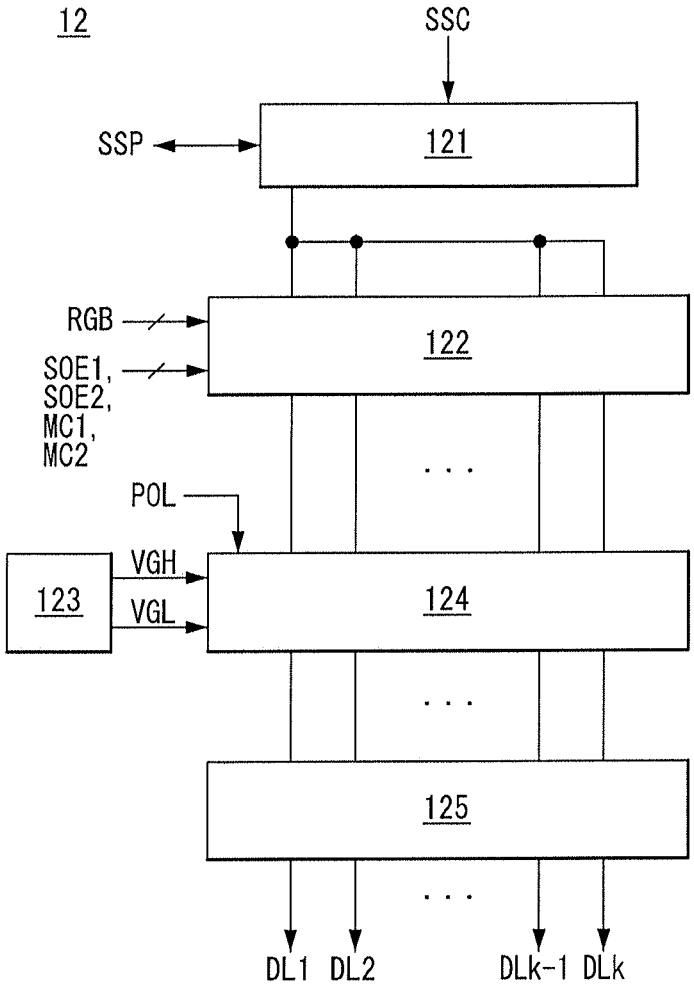
FIG. 6 schematically illustrates a configuration of a data driving circuit.

FIG. 6 schematically illustrates a configuration of the data driving circuit 12.

As shown in FIG. 6, the data driving circuit 12 includes a shift register 121, a latch array 122, a gamma compensation voltage generator 123, a digital-to-analog converter (DAC) 124, and an output circuit 125.

The shift register 121 shifts a sampling signal in response to the source sampling clock SSC.

The latch array 122 samples the digital video data RGB received from the timing controller 11 in response to the sampling signal sequentially input from the shift register 121, latches the digital video data RGB for each horizontal line, and performs the data rendering in accordance with the rendering structure of the pixel array shown in FIG. 5. For the data rendering, the latch array 122 temporally separates the first group data to be applied to the liquid crystal cells of the first group from the second group data to be applied to the liquid crystal cells of the second group in response to the data rendering control signals SOE1, SOE2, MC1, and MC2 received from the timing controller 11. Hence, the latch array 122 outputs the first group data earlier than the second group data by about 1/2 horizontal period.

The gamma compensation voltage generator 123 segments a plurality of gamma reference voltages into voltages as many as the number of gray levels that can be represented by the number of bits of the digital video data RGB. The gamma compensation voltage generator 123 generates a positive gamma compensation voltage VGH and a negative gamma compensation voltage VGL corresponding to each of the gray levels.

The DAC 124 includes a P-decoder to which the positive gamma compensation voltages VGH are supplied, an N-decoder to which the negative gamma compensation voltages VGL are supplied, and a selector for selecting an output of the P-decoder and an output of the N-decoder in response to the vertical polarity control signal POL. The P-decoder decodes the first and second group data input from the latch array 122 and outputs the positive gamma compensation voltage VGH corresponding to the gray level of the data. The N-decoder decodes the first and second group data input from the latch array 122 and outputs the negative gamma compensation voltage VGL corresponding to the gray level of the data. The selector selects the positive gamma compensation voltage VGH and the negative gamma compensation voltage VGL in response to the vertical polarity control signal POL.

The output circuit 125 includes a plurality of buffers respectively connected to output channels. The output circuit 125 minimizes signal attenuation of the analog data voltages supplied from the DAC 124 and then supplies the analog data voltages to the data lines DL1 to DLk of the liquid crystal display panel 10.

Figure 8:
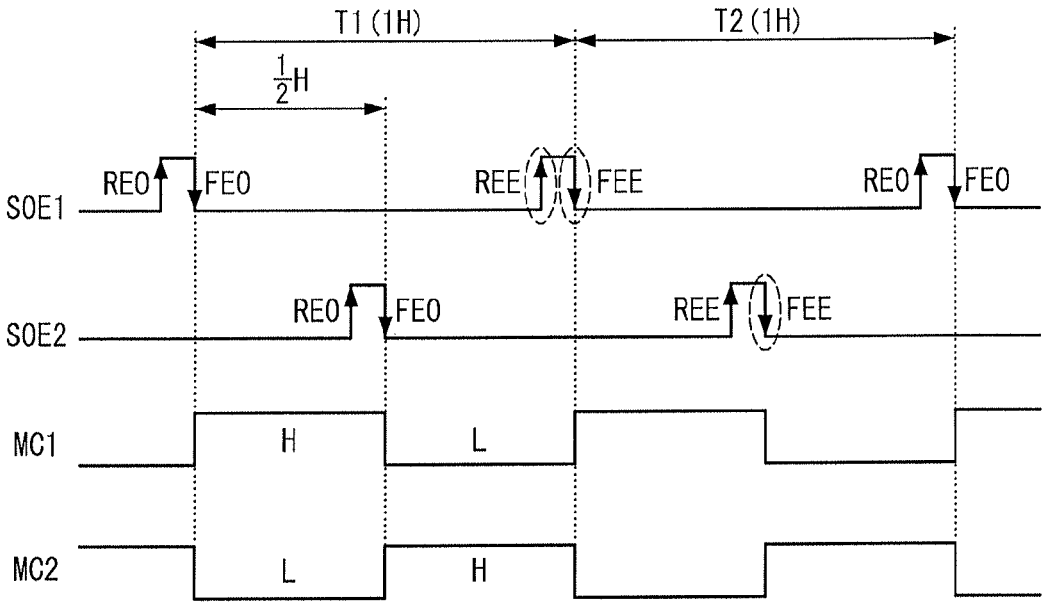
FIG. 8 illustrates control timings of a data rendering control signal.

FIG. 7 illustrates a detailed configuration of the latch array 122 capable of rendering data. FIG. 8 illustrates control timings of the data rendering control signals SOE1, SOE2, MC1, and MC2.

As shown in FIG. 7, the latch array 122 includes a first latch having a 1-1 latch 122A and a 1-2 latch 122B, a second latch 122C, a multiplexer 122D, and a third latch 122E.

As shown in FIG. 8, a first period T1 and a second period T2 each corresponding to one horizontal period 1H are defined by adjacent falling edges FEO and FEE of the first source output enable signal SOE1. The second source output enable signal SOE2 is generated later than the first source output enable signal SOE1 by 1/2 horizontal period H/2. The first MUX control signal MC1 is generated as a high logic level H during a first half period H/2 of the one horizontal period 1H and at a low logic level L during a second half period H/2 of the one horizontal period 1H. The second MUX control signal MC2 is generated at a logic level opposite the logic level of the first MUX control signal MC1. Namely, the second MUX control signal MC2 is generated at a low logic level L during the first half period H/2 of the one horizontal period 1H and at a high logic level H during the second half period H/2 of the one horizontal period 1H.

During the first period T1, the 1-1 latch 122A sequentially latches the first group data among the digital video data RGB for each horizontal line, and the 1-2 latch 122B sequentially latches the second group data among the digital video data RGB for each horizontal line. At a rising edge REE of the first source output enable signal SOE1 included in the first period T1, the 1-1 latch 122A outputs the latched first group data to the multiplexer 122D, and at the same time the 1-2 latch 122B outputs the latched second group data to the second latch 122C.

The multiplexer 122D electrically connects the 1-1 latch 122A to the third latch 122E during the first half horizontal period H/2 of the second period T2 in response to the first MUX control signal MC1. Also, the multiplexer 122D electrically connects the second latch 122C to the third latch 122E during the second half horizontal period H/2 of the second period T2 in response to the second MUX control signal MC2.

The third latch 122E outputs the first group data received from the 1-1 latch 122A to the DAC 124 through the multiplexer 122D during the first half horizontal period H/2 of the second period T2 starting from a falling edge FEE of the first source output enable signal SOE1. Further, the third latch 122E outputs the second group data received from the second latch 122C to the DAC 124 through the multiplexer 122D during the second half horizontal period H/2 of the second period T2 starting from a falling edge FEE of the second source output enable signal SOE2. The second latch 122C holds the second group data during the first half horizontal period H/2 of the second period T2, so that the second group data is output later than the first group data by 1/2 horizontal period H/2.

In this way, the embodiment of the invention implements the functions of a related art line memory by means of the second latch 122C. Because the second latch 122C includes flip-flops cheaper than the line memory, the liquid crystal display according to the embodiment of the invention can greatly reduce the manufacturing cost compared to the related art liquid crystal display.

Figure 9:
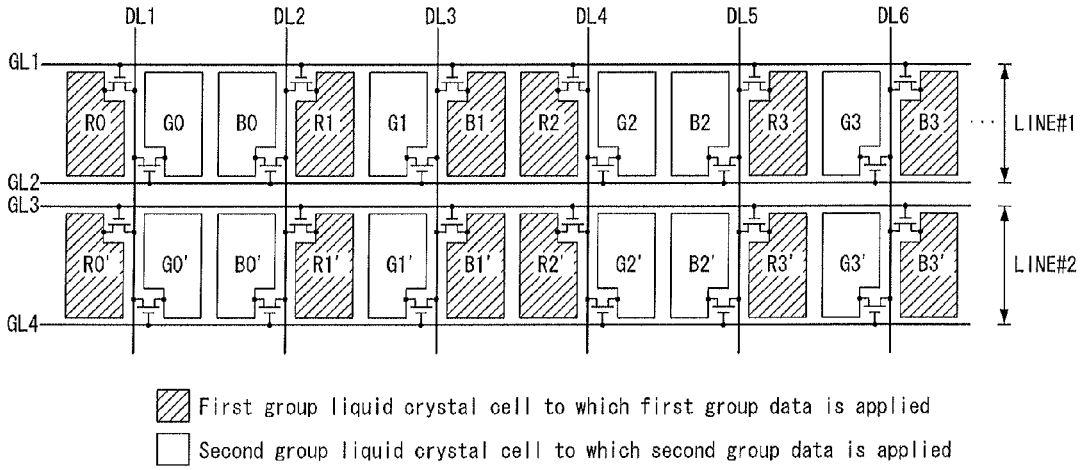
FIGS. 9 and 10 illustrate an example of performing data rendering of a latch array.
Figure 10:
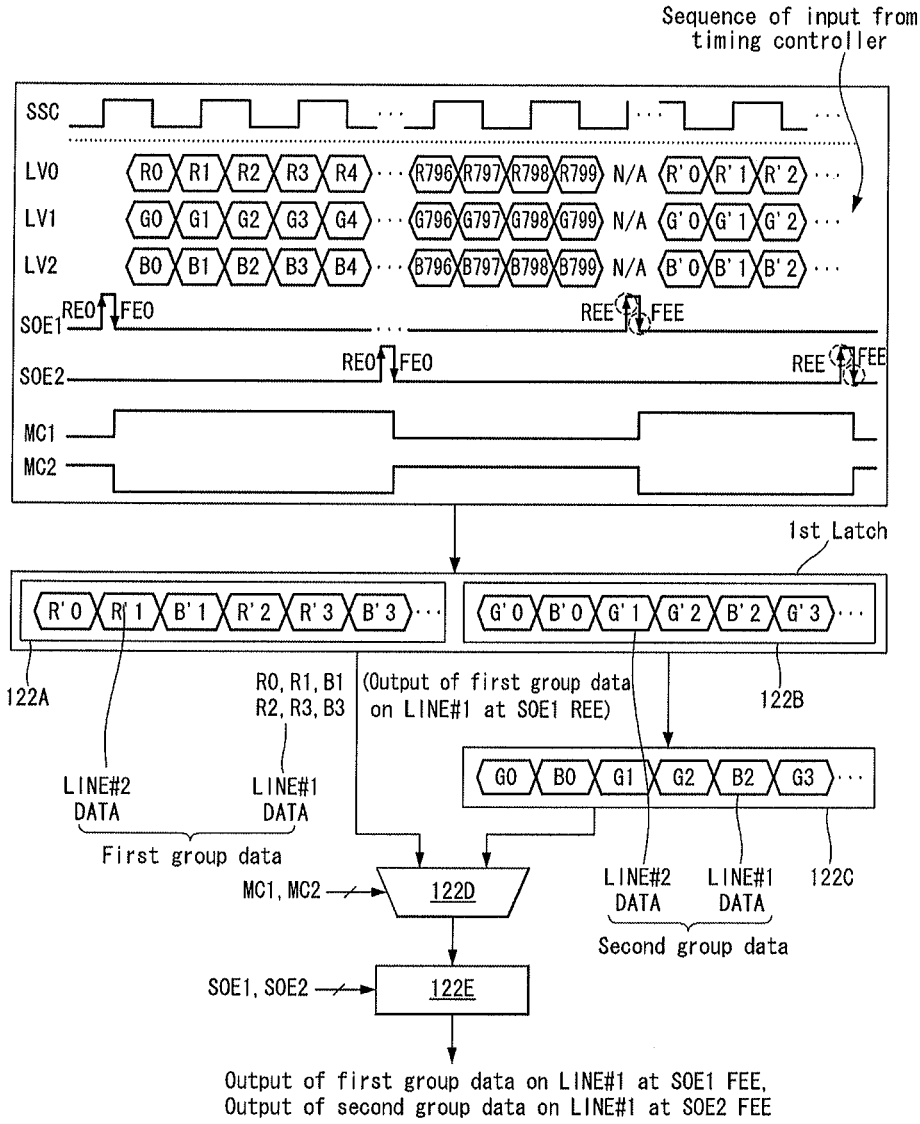

FIGS. 9 and 10 illustrate an example of performing the data rendering of the latch array.

Referring to FIGS. 9 and 10, taken in conjunction with FIGS. 7 and 8, description will now be given on how data to be applied to the first horizontal line LINE#1 and data to be applied to the second horizontal line LINE#2 are actually stored in the latch array 122 and output therefrom.

The data to be applied to the first horizontal line LINE#1 and the data to be applied to the second horizontal line LINE#2 are input to the latch array 122 without performing a separate alignment process through the timing controller 11. That is, the data to be applied to the first horizontal line LINE#1 is input to the latch array 122 in the order of R0, G0, B0, . . . R799, G799, and B799, and the data to be applied to the second horizontal line LINE#2 is input to the latch array 122 in the order of R'0, G'0, B'0, R'799, G'799, and B'799.

During the first period T1, the 1-1 latch 122A sequentially latches the first group data R0, R1, B1, R2, R3, B3, . . . among the data R0, G0, B0, . . . R799, G799, and B799 corresponding to one horizontal line to be applied to the first horizontal line LINE#1. Further, during the first period T1, the 1-2 latch 122B sequentially latches the second group data G0, B0, G1, G2, B2, G3, . . . among the data R0, G0, B0, . . . R799, G799, and B799 corresponding to one horizontal line to be applied to the first horizontal line LINE#1. At a rising edge REE of the first source output enable signal SOE1 included in the first period T1, the 1-1 latch 122A outputs the latched first group data R0, R1, B1, R2, R3, B3, . . . to the multiplexer 122D, and at the same time the 1-2 latch 122B outputs the latched second group data G0, B0, G1, G2, B2, G3, . . . to the second latch 122C.

Afterwards, during the second period T2, the 1-1 latch 122A sequentially latches the first group data R'0, R'1, B'1, R'2, R'3, B'3, . . . among the data R'0, G'0, B'0, . . . R'799, G'799, and B'799 corresponding to one horizontal line to be applied to the second horizontal line LINE#2. During the second period T2, the 1-2 latch 122B sequentially latches the second group data G'0, B'0, G'1, G'2, B'2, G'3, . . . among the data R'0, G'0, B'0, . . . R'799, G'799, and B'799 corresponding to one horizontal line to be applied to the second horizontal line LINE#2.

The multiplexer 122D electrically connects the 1-1 latch 122A to the third latch 122E in response to the first MUX control signal MC1 during the first half horizontal period H/2 of the second period T2. Further, the multiplexer 122D electrically connects the second latch 122C to the third latch 122E in response to the second MUX control signal MC2 during the second half horizontal period H/2 of the second period T2.

The third latch 122E outputs the first group data R0, R1, B1, R2, R3, B3, . . . input from the 1-1 latch 122A to the DAC 124 through the multiplexer 122D during the first half horizontal period H/2 of the second period T2 starting from the falling edge FEE of the first source output enable signal SOE1. Further, the third latch 122E outputs the second group data G0, B0, G1, G2, B2, G3, . . . input from the second latch 122C to the DAC 124 through the multiplexer 122D during the second half horizontal period H/2 of the second period T2 starting from the falling edge FEE of the second source output enable signal SOE2.

Figure 11:
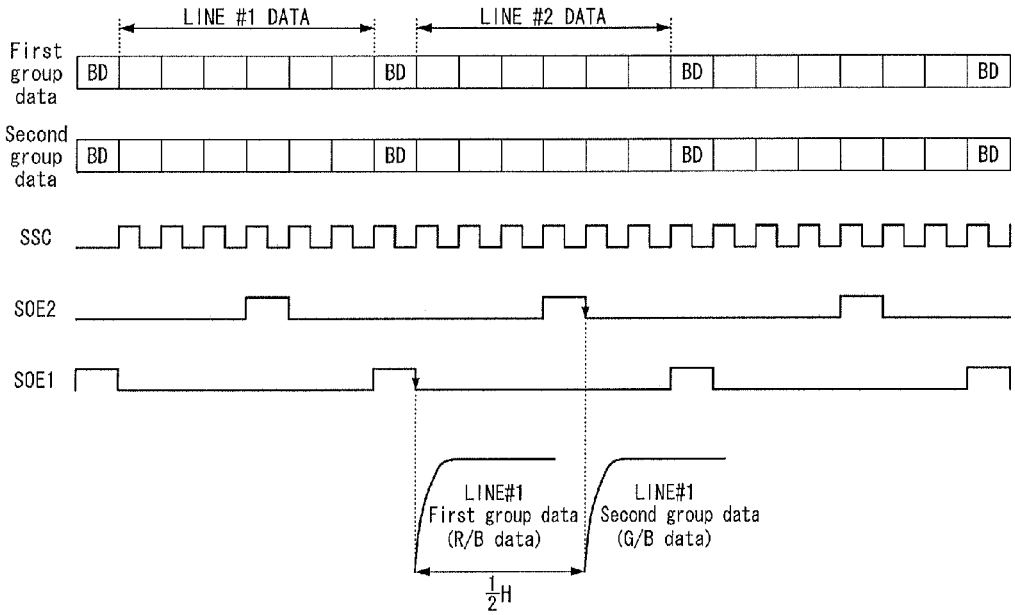
FIG. 11 illustrates a reason why one second latch can be used.

FIG. 11 illustrates a reason why the second latch includes one latch while the first latch includes the two latches 122A and 122B.

A method may be considered to form a separate second latch for storing the first group data (i.e., R and B data) between the 1-1 latch 122A and the multiplexer 122D shown in FIG. 7. However, the separate second latch is Unnecessary because of the following reasons. Thus, the optimum latch array can be achieved by omitting the separate second latch from the latch array, and also power consumption of the data driving circuit and the manufacturing cost of the liquid crystal display can be reduced.

As shown in FIG. 11, the second group data (i.e., G and B data) of the first horizontal line LINE#1 has to be delayed by an output time of the first group data (i.e., R and B data) of the first horizontal line LINE#1 in accordance with the data sequence. Thus, the second latch holds the second group data (i.e., G and B data) during the 1/2 horizontal period H/2 corresponding to the output time of the first group data (i.e., R and B data). However, because the first group data (i.e., R and B data) of the first horizontal line LINE#1 is output without the delay, the separate second latch for storing the first group data (i.e., R and B data) is not necessary between the 1-1 latch 122A and the multiplexer 122D.

As described above, the liquid crystal display according to the embodiment of the invention adds the relatively cheap latches so as to satisfy the rendering structure of the DRD panel and performs the data rendering, which has been conventionally performed in the timing controller, in the latch array of the data driving circuit, thereby omitting the line memory, which increases the manufacturing cost, from the timing controller and significantly increasing cost competitiveness.

Furthermore, the liquid crystal display according to the embodiment of the invention stores only the second group data requiring the time delay in the second latch and directly outputs the first group data not requiring the time delay without storing it in the second latch, thereby reducing the number of latches in the latch array by one. Further, the optimum latch array can be achieved, and also power consumption of the data driving circuit and the manufacturing cost of the liquid crystal display can be reduced.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A liquid crystal display comprising:

a liquid crystal display panel having a pixel array including a first group of liquid crystal cells connected to odd-numbered gate lines and a second group of liquid crystal cells connected to even-numbered gate lines, wherein each liquid crystal cell of the second group is configured to share a data line with one liquid crystal cell of the first group;

a data driving circuit configured to drive data lines of the pixel array in a time-division manner, the data driving circuit including a latch array; and a timing controller configured to supply digital video data to the data driving circuit and control operation timing of the data driving circuit, wherein the latch array delays only second group data to be applied to the liquid crystal cells of the second group among the digital video data for one horizontal line by one half horizontal period in response to a data rendering control signal and temporally separates first group data to be applied to the liquid crystal cells of the first group from the second group data to be applied to the liquid crystal cells of the second group, wherein the data rendering control signal received from the timing controller includes a first source output enable signal for controlling output timing of the first group data, and a second source output enable signal for controlling output timing of the second group data, and wherein the second source output enable signal is generated only once every one horizontal period, and generated later than the first source output enable signal by one half horizontal period.

2. The liquid crystal display of claim 1, wherein the data rendering control signal received from the timing controller further includes:

a MUX control signal for controlling an output operation of a multiplexer included in the latch array.

3. The liquid crystal display of claim 2, wherein a first period and a second period each corresponding to one horizontal period are defined by adjacent falling edges of the first source output enable signal.

4. The liquid crystal display of claim 3, wherein the latch array includes:

a 1-1 latch configured to sequentially latch the first group data during the first period;

a 1-2 latch configured to sequentially latch the second group data during the first period;

a second latch configured to receive the second group data from the 1-2 latch at a rising edge of the first source output enable signal included in the first period; and a third latch configured to output the first group data received from the 1-1 latch through the multiplexer during a first half horizontal period of the second period starting from a falling edge of the first source output enable signal and output the second group data received from the second latch through the multiplexer during a second half horizontal period of the second period starting from a falling edge of the second source output enable signal, wherein the 1-1 latch is configured to output the first group data to the multiplexer at the rising edge of the first source output enable signal included in the first period.

5. The liquid crystal display of claim 4, wherein the MUX control signal includes a first MUX control signal and a second MUX control signal, wherein the multiplexer electrically connects the 1-1 latch to the third latch in response to the first MUX control signal, wherein the multiplexer electrically connects the second latch to the third latch in response to the second MUX control signal, and wherein the second MUX control signal is generated at a logic level opposite the logic level of the first MUX control signal.

6. The liquid crystal display of claim 4, wherein the second latch holds the second group data during the first half horizontal period of the second period, so that the second group data is output later than the first group data by about one half horizontal period.

7. The liquid crystal display of claim 1, wherein the pixel array includes red liquid crystal cells, green liquid crystal cells and blue liquid crystal cells, wherein the first group of liquid crystal cells include all of the red liquid crystal cells and one half of the blue liquid crystal cells of the pixel array, wherein the second group of liquid crystal cells include all of the green liquid crystal cells and the other half of the blue liquid crystal of the pixel array.

8. The liquid crystal display of claim 1, wherein the latch array is implemented as a flip-flop.

9. The liquid crystal display of claim 1, wherein when the odd-numbered gate lines connected to the liquid crystal cells of the first group are activated, the liquid crystal cells of the first group are charged with the first group data during a first half horizontal period of one horizontal period, wherein when the even-numbered gate lines connected to the liquid crystal cells of the second group are activated, the liquid crystal cells of the second group are charged with the second group data during a second half horizontal period of the one horizontal period.

* * * * *